United States Patent [19]

Mitchell

[11] 4,295,227

[45] Oct. 20, 1981

[54] SHOULDER PAD

[75] Inventor: Hal D. Mitchell, Rolla, Mo.

[73] Assignee: A-T-O Inc., Willoughby, Ohio

[21] Appl. No.: 143,899

[22] Filed: Apr. 25, 1980

[51] Int. Cl.[3] ..... A41D 13/00

[52] U.S. Cl. ..... 2/2

[58] Field of Search ..... 2/2, 268

[56] References Cited

U.S. PATENT DOCUMENTS

| | | | |
|---|---|---|---|
| Re. 22,084 | 4/1942 | Lookabaugh | 2/2 |
| 2,251,018 | 7/1941 | Lookabaugh | 2/2 |
| 3,740,763 | 6/1973 | Mitchell | 2/2 |
| 3,867,726 | 2/1975 | Owl et al. | 2/2 |
| 4,135,252 | 1/1979 | Latina et al. | 2/2 |
| 4,158,242 | 6/1979 | Mitchell | 2/2 |

*Primary Examiner*—Louis Rimrodt

*Attorney, Agent, or Firm*—Senniger, Powers, Leavitt and Roedel

[57] ABSTRACT

A shoulder pad for football players comprising a left-hand member which fits over the left shoulder and a right-hand member which fits over the right shoulder. Each of the members is a relatively rigid member of generally inverted U-shape as viewed from the side and has a chestplate portion, a backplate portion and an arch integrally connecting the plate portions. Each member has padding on the inside thereof with the padding at the top of the arch comprising an inner portion beneath the arch and an outer portion extending laterally outwardly beyond the arch. The outer portion has front and back sections which are separate toward their outer ends for allowing the sections to spread apart on upward movement of the outer part of the shoulder. A cover pad overlies the separate outer ends of the front and back sections and is hinged to the inner portion of the arch padding for permitting the cover pad to swing upwardly on upward movement of the arm at the shoulder. A cap with padding on the inside thereof overlies the cover pad.

7 Claims, 5 Drawing Figures

SHOULDER PAD

BACKGROUND OF THE INVENTION

This invention relates generally to athletic apparel, and more particularly to a shoulder pad for football players.

Shoulder pads as conventionally designed have been extremely bulky and cumbersome and have severely restricted upper body movement, particularly upward movement of the arms and shoulders. Reference may be made to coassigned U.S. Pat. No. 4,158,242 on which the present invention is an improvement.

SUMMARY OF THE INVENTION

Among the several objects of this invention may be noted the provision of an improved shoulder pad which allows greater mobility of the upper body of the wearer, particularly the shoulders, so that the arms may be raised without undue interference from the shoulder pad; the provision of such a shoulder pad which provides added protection for the shoulders of the wearer; the provision of such a shoulder pad which is compact and simple in design; and the provision of such a shoulder pad which is economical to manufacture and easy to maintain.

Generally, a shoulder pad of this invention comprises a left-hand member adapted to fit over the left shoulder that a right-hand member adapted to fit over the right shoulder. Each of the members is a relatively rigid member of generally inverted U-shape as viewed from the side and has a chestplate portion, a backplate portion and an arch integrally connecting the plate portions. The arches are laterally spaced to provide an opening for the neck of the wearer with the spacing such that the arches lie adjacent and relatively close to the neck. Each member has padding on the inside thereof with the padding at the top of the arch comprising an inner portion generally beneath the arch adapted to overlie the inner part of a respective shoulder and an outer portion extending laterally outwardly beyond the arch adapted to overlie the outer part of the shoulder. The outer portion comprises a front section adjacent the chestplate portion and a back section adjacent the backplate portion, the front and back sections being separate toward their outer ends for allowing the sections to spread apart upon upward movement of the outer part of the shoulder. Each member further comprises a cover pad extending laterally outwardly from the inner portion of the arch padding over the separate outer ends of the front and back sections of the arch padding at the top of the shoulder. The cover pad is hinged to the inner portion of the arch padding for permitting the cover pad to swing upwardly on upward movement of the arm at the shoulder. A cap with padding on the inside thereof overlies the cover pad and is adapted to fit over the outer part of the shoulder.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
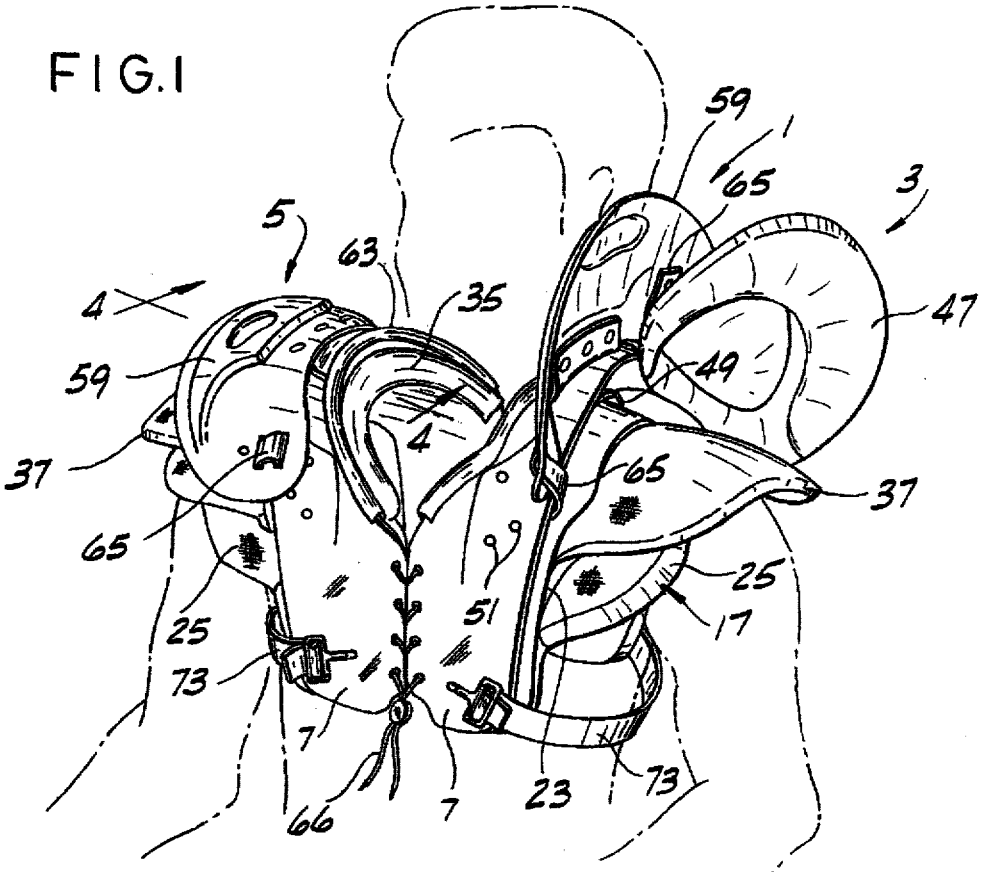
FIG. 1 is a perspective of a shoulder pad of the present invention being worn by a football player, a flap and a cap of the left-hand member of the shoulder pad being raised to illustrate details.
Figure 4:
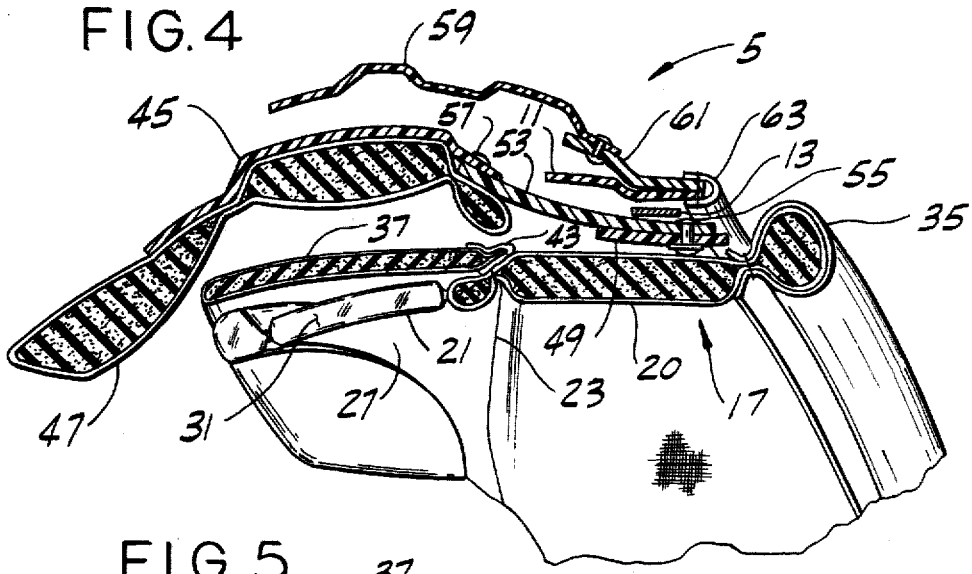
FIG. 4 is an enlarged vertical section on line 4—4 of FIG. 1.

Referring to the drawings, a shoulder pad made according to the present invention is designated generally by the reference numeral 1 and is shown in FIG. 1 worn by a football player. It comprises a left-hand member generally indicated at 3 which fits over the left shoulder of the player and a right-hand member generally indicated at 5 which fits over the right shoulder. These two members 3, 5 may be of a suitable relatively lightweight molded plastic material, such as a high density polyetylene having a sufficiently high impact resistance to withstand the heavy blows received during the course of a football game. Each of the members is of generally inverted U-shape as viewed from the side and comprises a chestplate portion 7, a backplate portion 9 and an arch 11 integrally connecting the plate portions 7, 9. The arches 11 of the two members are laterally spaced to provide an opening for the neck of the wearer with the spacing such that the arches lie adjacent and relatively close to the neck. As best illustrated in FIG. 4, a curved, relatively stiff member 13, extends along the underside of each arch and is affixed by rivets 15 at its ends to the arch.

For added protection, each of the members 3, 5 has padding generally indicated at 17 secured (e.g., stitched) to the inside thereof, which padding preferably comprises a closed-cell elastomeric vinyl foam in a stretch fabric cover. The portion of padding 17 at the top of each shoulder, referred to as arch padding, comprises an inner portion 20 beneath arch 11 adapted to overlie the inner part of the shoulder adjacent the neck of the wearer and an outer portion generally indicated at 21 adapted to overlie the outer part of the shoulder. The chestplate portion 7, backplate portion 9 and arch 11 of each member and the inner portion 20 of the padding 17 thus protect the body and the inner portion of the shoulder of the wearer, including the sternum, the ribs, the rib cartilages, the clavicle and the musculature along the midline of the back of the wearer. The outer portion 21 of the arch padding protects the outer part of the shoulder, particularly the pectoral muscles at their point of attachment to the humerous bone, the lateral aspects of the scapula, and the muscles attaching the scapula to the humerous bone.

Figure 2:
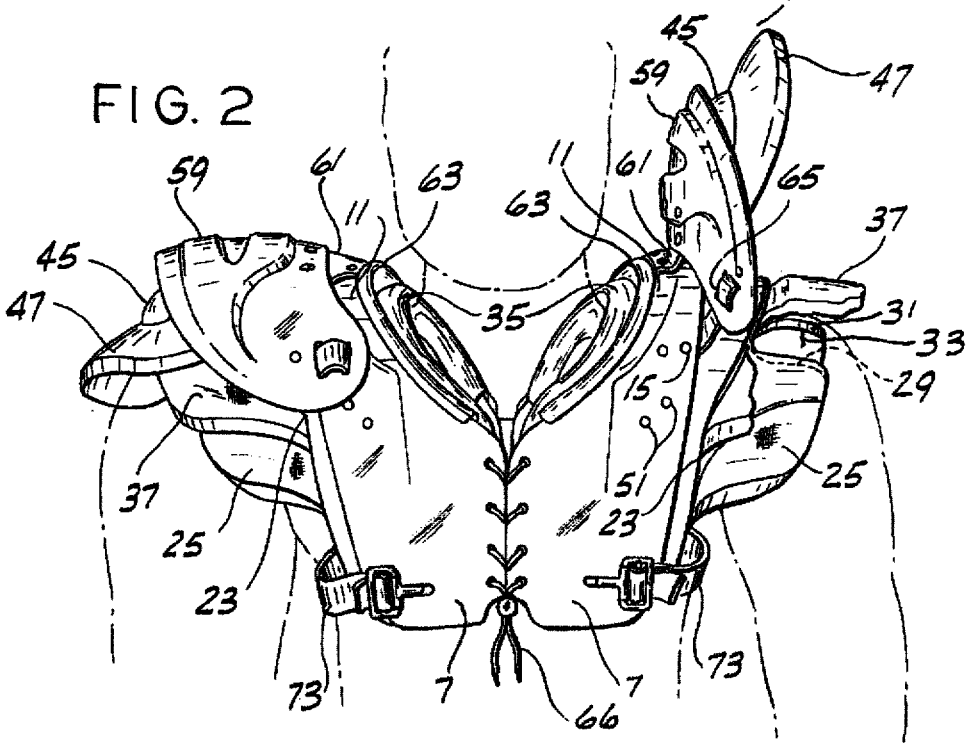
FIG. 2 is a front elevation of FIG. 1 with portions broken away.
Figure 3:
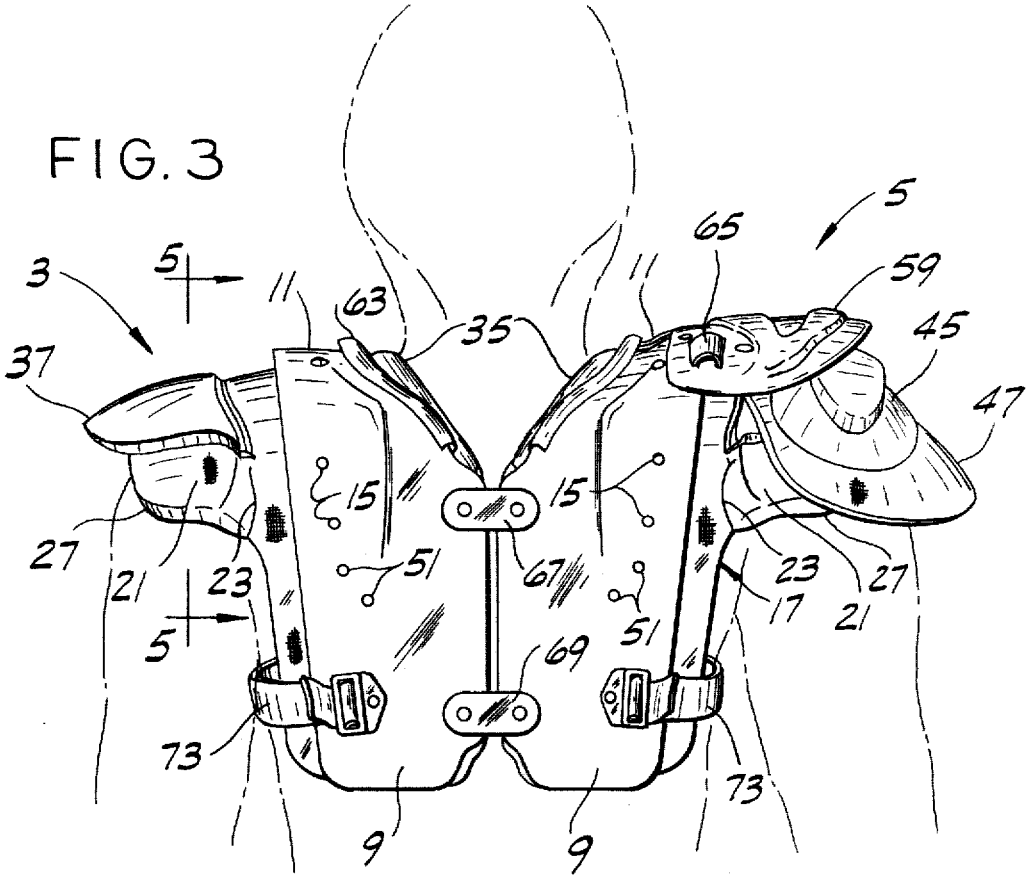
FIG. 3 is a rear elevation of FIG. 1 with the flap and cap of the left-hand member removed.

In accordance with the present invention, the outer portion 21 of padding 17 is hinged to the inner portion 20 along a line of stitching 23 and is divided into a front section 25 (see FIG. 2) generally adjacent a respective chestplate portion 7 and a back section 27 (see FIG. 3) generally adjacent a respective backplate portion 9. These sections 25, 27 are separate toward their outer ends, the front section 25 terminating in a rear edge 29 adjacent the top of the shoulder and the back section 27 terminating in a forward edge 31 adjacent the top of the shoulder. Edges 29 and 31 are spaced apart, a recess or slot 33 thereby being formed in padding 17 at the outer part of the top of the shoulder. This hinge-and-slot construction is advantageous in that it allows the front and back sections 25, 27 of the outer portion 21 of the padding readily to swing upwardly about line of stitching 23 on upward movement of the arm at the shoulder. Moreover, this construction permits the sections freely to spread apart (in accordance with their natural tendency) during such movement. Thus, freedom is provided for raising the arms by permitting upward movement of the arms at the shoulders without substantial interference from the padding 17. While the front and back sections 25, 27 are shown in the drawings as being integrally formed toward their inner ends, it will be understood that these sections may be entirely separate.

Welted neck padding 35 is provided at the inner edge of arch padding 17 for affording added protection to the neck of the wearer. This neck padding 35 is positioned inwardly of the arch 11 for holding the latter away from the neck of the wearer.

Shoulder pad 1 further comprises a pair of cover pads 37 which cover slots 33 in padding 17. Each pad 37 is of the same construction as arch padding 17 and extends laterally outwardly from the inner portion 20 of the arch padding of a respective member over the separate outer ends of front and back sections 25, 27 at the top of the shoulder. Each cover pad 37 is stitched along its inner edge to the arch padding 17 at line of stitching 23, the cover pad thus being hinged to padding 17 for swinging upwardly on upward movement of the arm at the shoulder, as when the arms are raised. The cover pad 37 is sufficiently large in size to cover the slot 33 in the arch padding when the front and back sections are spread apart upon upward movement of the arm at the shoulder. A strip 43 of fabric or other suitable material is folded around and secured to the inner edge of the cover pad for reinforcing the latter at line of stitching 23.

A pair of caps, each designated 45, overlie the outer portions 21 of padding 17 and provide additional protection for the outer part of the shoulders which are particularly injury-prone. These caps 45 are of suitably rigid lightweight material, are generally convex in shape, and have padding 47 of the same construction as padding 17 stitched to the inside thereof. As shown in FIGS. 1 and 4, each cap is flexibly connected to a strap 49 of relatively pliable material extending along the inner portion 20 of padding 17 below member 13. This strap 49, which may be referred to as a "cantilever" strap, is secured at its ends to the arch 11 by rivets or other suitable permanent fasteners 51. Cap 45 is connected to strap 49 by means of a flexible band 53, the inner end of which (the right end as viewed in FIG. 4) is riveted at 55 to strap 49 and the outer end of which is riveted at 57 to the underside of cap 45 between the cap and cap padding 47. Inasmuch as band 53 is connected to the cantilever strap rather than directly to the arch 11, the cover pad fits snugly against the underside of the cap.

Figure 5:
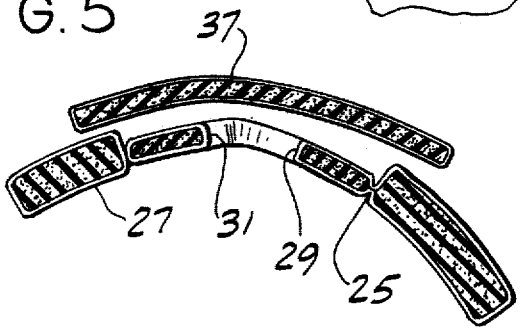
FIG. 5 is an enlarged vertical section on line 5—5 of FIG. 3.

As best illustrated in FIG. 5, the front (right) section 25 of the arch padding is of greater thickness toward its front than its back, and the back (left) section 27 of the arch padding is of greater thickness toward its back than its front so that the cover pad 37 fits snugly over the front and back sections of the arch padding. This provides greater compactness of the shoulder pads at the outer part of the shoulders.

A relatively rigid flap 59 overlies each cap 45 and is hinged to a respective arch 11 at the top of the arch via a main hinge strap 61. A trim strip 63 is doubled over the inner edge of arch 11 and hinge strap 61 for added protection. As indicated at 65, a pair of snubber straps connect flap 59 to the arch 11 at the front and back of the flap for restricting movement of the flap relative to the arch.

As illustrated, the chestplate portions 7 are laced together at 66. However, the backplate portions 9 are connected by a parallelogram linkage arrangement which allows the backplates to shift relative to each other generally in the plane of the backplate portions. More specifically, this linkage comprises a first link 67 pivoted at its ends to the upper portions of the backplate portions, and a second link 69 pivotally connecting the lower portions of the backplate portions. It will, of course, be understood that additional links could be provided for further strength. Adjustable elastic body straps 73 interconnect the chestplate and backplate portions 7, 9 and are worn under the arms of the wearer to prevent displacement of the shoulder pad 1 upwardly and for otherwise keeping the shoulder pad properly positioned on the athlete.

It will be observed from the above that the improved shoulder pad 1 of this invention allows freedom of movement of the upper body of the athlete, particularly the shoulders, so that the arms may be moved above a horizontal position without substantial interference from the arch padding 17, cover pads 37, or caps 45, while providing protection for the outer part of the shoulders.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A shoulder pad for football players comprising a left-hand member adapted to fit over the left shoulder and a right-hand member adapted to fit over the right shoulder, each of said members being a relatively rigid member of generally inverted U-shape as viewed from the side and having a chestplate portion, a backplate portion and an arch integrally connecting said plate portions, said arches being laterally spaced to provide an opening for the neck of the wearer with the spacing such that said arches lie adjacent and relatively close to the neck, each of said members having padding on the inside thereof with the padding at the top of the arch comprising an inner portion generally beneath the arch adapted to overlie the inner part of a respective shoulder and an outer portion extending laterally outwardly beyond the arch adapted to overlie the outer part of said shoulder, said outer portion comprising a front section adjacent the chestplate portion and a back section adjacent the backplate portion, said front and back sections being separate toward their outer ends for allowing the sections to spread apart upon upward movement of the arm at the shoulder, each member further comprising a cover pad extending laterally outwardly from said inner portion of the arch padding over the separate outer ends of said front and back sections of the arch padding at the top of the shoulder, said cover pad being hinged to the inner portion of the arch padding for permitting the cover pad to swing upwardly on upward movement of the arm at the shoulder, and a cap with padding on the inside thereof overlying said cover pad and adapted to fit over the outer part of the shoulder.

2. A shoulder pad as set forth in claim 1 wherein said front section of the arch padding terminates in a rear edge adjacent the top of the shoulder and said back section terminates in a forward edge adjacent the top of the shoulder, said forward and rear edges being spaced apart providing a recess therebetween.

3. A shoulder pad as set forth in claim 2 wherein said cover pad is sufficiently large in size to cover said recess when said front and back sections of the arch padding are spread apart due to said upward movement of the outer part of a respective shoulder.

4. A shoulder pad as set forth in claim 1 wherein said front and back sections of the arch padding are hinged to the inner portion of the arch padding for enabling them to swing upwardly about a hinge line upon upward movement of the outer part of the shoulder.

5. A shoulder pad as set forth in claim 1 wherein said hinge line comprises a line of stitching in the arch padding, said cover pad being stitched to the arch padding adjacent said line of stitching.

6. A shoulder pad as set forth in claim 5 further comprising a strip of material folded around the inner edge of the cover pad for reinforcing the cover pad at said line of stitching.

7. A shoulder pad as set forth in claim 1 wherein said front section of the arch padding is of greater thickness toward its front than its back and said back section of the arch padding is of greater thickness toward its back than its front.

* * * * *